US005651570A

United States Patent [19]

Schrum et al.

[11] Patent Number: 5,651,570

[45] Date of Patent: Jul. 29, 1997

[54] CAM OPERATED TOOL FOR PROXIMATE OR REMOTE HOLDING OF AN OBJECT

[75] Inventors: Phillip B. Schrum, Jefferson Boro; George P. Gajdzak, Belle Vernon, both of Pa.

[73] Assignee: The United States of America as represented by the United States Department of Energy, Washington, D.C.

[21] Appl. No.: 471,614

[22] Filed: Jun. 1, 1995

[51] Int. Cl.[6] ..... B66C 1/66

[52] U.S. Cl. ..... 294/1.1; 294/82.24; 294/86.4; 294/90; 403/348

[58] Field of Search ..... 294/1.1, 82.24, 294/82.28, 86.1, 86.17, 86.2, 86.21, 86.24–86.26, 86.4, 90, 93, 94, 110.2, 906; 285/358, 360, 376, 401; 403/348, 360, 350; 901/30, 31

[56] References Cited

U.S. PATENT DOCUMENTS

| | | | |
|---|---|---|---|
| 1,425,525 | 8/1922 | Hollick | 294/86.1 X |
| 1,717,497 | 6/1929 | Davis | 294/86.17 |
| 3,072,430 | 1/1963 | Fahrenwald | 294/90 X |
| 4,273,464 | 6/1981 | Scott | 294/86.1 X |
| 4,483,563 | 11/1984 | van der Heyden | 294/90 |

*Primary Examiner*—Johnny D. Cherry

*Attorney, Agent, or Firm*—John T. Lucas; William R. Moser; Paul A. Gottlieb

[57] ABSTRACT

A tool for releasably holding an object includes a receptacle having an outer sleeve and a rotatable inner sleeve. The inner sleeve is coaxially positioned within the outer sleeve and includes a locking member. An insert which is adapted to be operably associated with the receptacle includes a cam. The cam includes a guide and a slot so that when the cam is inserted into the inner sleeve, the guide aligns the locking member with the slot allowing the locking member to engage the slog thereby holding the receptacle and the insert together.

20 Claims, 2 Drawing Sheets

CAM OPERATED TOOL FOR PROXIMATE OR REMOTE HOLDING OF AN OBJECT

FIELD OF THE INVENTION

The present invention relates generally to a tool for proximate or remote holding of an object, and more specifically, to a cam operated tool with a single moving piece, that can readily and positively engage and disengage an object to be lifted.

BACKGROUND OF THE INVENTION

Conventional proximate or remote operated tools typically include a number of moving parts which make operation more complicated and results in a less reliable tool. For example, a prior tool uses a spring activated engagement mechanism for engaging a specially designed hole in a receptacle attached to the top of the object to be lifted. The engagement mechanism has exposed finger-like spring leafs arranged in a circular fashion which compress and expand to engage the receptacle when inserted into the hole of the receptacle. After insertion, a nut must then be manually threaded onto the receptacle to make a more permanent connection and to take the weight of the object being lifted off of the engagement mechanism. As a result of the exposed spring leafs and the associated moving parts, this tool often breaks and does not properly engage. This often results in damage to the object being picked up when it is prematurely released due to improper engagement.

In view of the drawbacks associated with the conventional tools, there is a need for a better tool for picking-up objects. In particular, a better design for a tool with a holding mechanism is needed to allow a Powered Axial Locating Mechanism (PALM) to connect to or disconnect from a test train. The PALM was designed in 1982 for operation on top of a test reactor as a means for moving test trains which contain fueled specimens up and down or in and out of the flux region of a reactors simulating power cycles.

A reliable holding tool is thus needed which can be attached to the end of the PALM actuator, so that when PALM is driven down below a transfer shield plate, the mechanism can easily attach to the top of a test train allowing the test train to be pulled above the transfer shield plate. In addition, a reliable holding tool is needed which can be easily disconnected from the top of a test train to disengage the PALM unit for removal from the reactor top.

OBJECTS AND SUMMARY OF THE INVENTION

It is therefore a principal object of the present invention to provide a tool for proximate or remote holding of an object which is simple, reliable and readily engages and disengages objects.

It is an object of the present invention to provide a tool for proximate or remote holding of an object which has uses in many industries, such as oil and gas industries.

It is another object of the present invention to provide a tool for proximate or remote holding of an object which has only one moving part and no spring operated components.

It is another object of the present invention to provide a tool for proximate or remote holding of an object which can be remotely operated.

It is yet another object of the present invention to provide a tool for proximate or remote holding of object which is cam operated.

It is yet another object of the present invention to provide a tool for proximate or remote holding of an object which is corrosion resistant allowing use in both air and liquid environments.

It is another object of the present invention to provide a remotely operated tool for proximate or remote holding of an object in a radioactive environment.

It is still another object of the present invention to provide a tool for proximate or remote holding of an object which does not need to be mechanically reset after each use.

It is yet another object of the present invention to provide a tool for proximate or remote holding of an object having a receptacle and an insert, such that the receptacle can be randomly oriented and still properly engage the insert.

In summary the present invention is directed to a proximate or remote cam operated tool with a single moving part that can readily engage and hold an object and can also readily disengage the object.

BRIEF DESCRIPTIONS OF THE DRAWINGS

These and other objects, advantages and novel features of the present invention will become apparent from the following detailed description taken in consideration of the accompanying drawings, in which.

Figure 5:
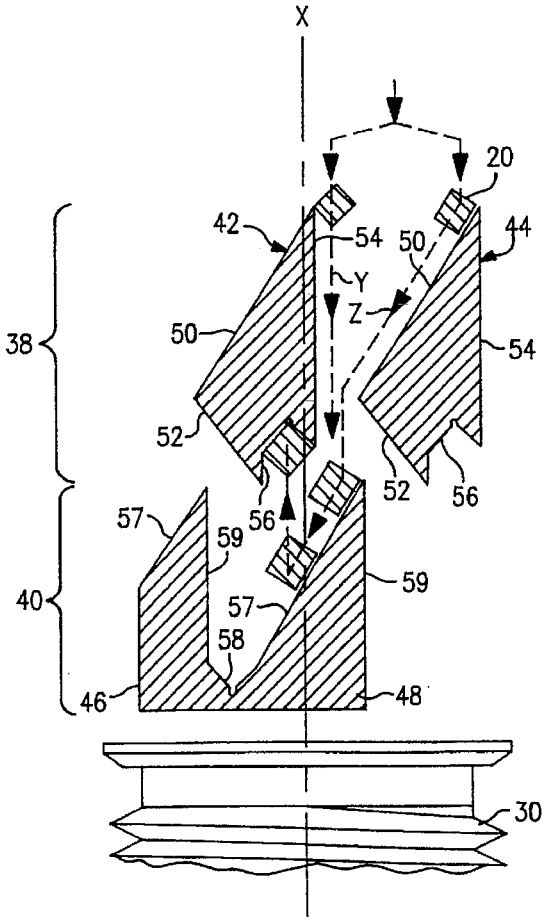
Figure 6:
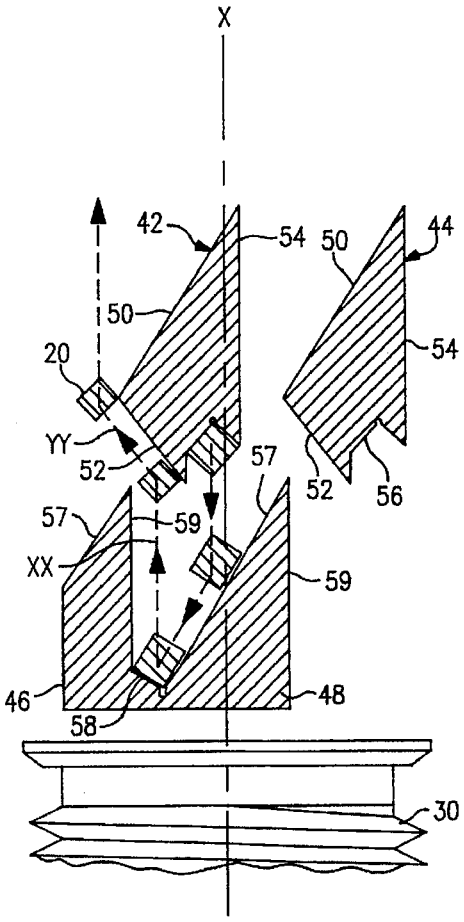

FIG. 5 is a developmental view of the insert with the cam spirals laid out flat and a locking nib shown in cross-section for convenience, showing the path of the locking nib for engagement with the cam; and FIG. 6 is a developmental view of the insert with the cam spirals laid out flat and a locking nib shown in cross-section for convenience, showing the path of the locking nib for disengagement with the cam.

DETAILED DESCRIPTION OF THE INVENTION

In the accompanying drawings, FIGS. 1–4 disclose the preferred embodiment of tool T of the present invention with the receptacle designated as R and the insert designated as I. Tool T is preferably made of a corrosion-resistant metal which allows it to be used in a number of environments, such as air and water.

Figure 1:
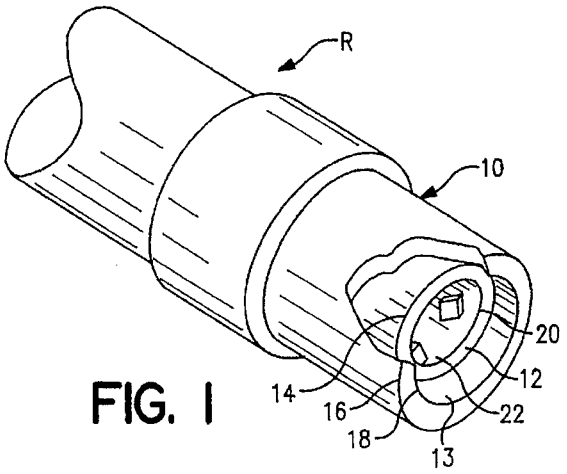
FIGS. 1 and 2 show the tool of the present invention, with FIG. 1 showing a partial perspective view of the receptacle of the present invention with a portion broken away to show the inner rotatable sleeve, and FIG. 2 showing a perspective view of the insert of the present invention.

As shown in FIG. 1, receptacle R includes a generally cylindrical protective housing or outer sleeve 10 with a rotatable inner sleeve 12 coaxially positioned therein. Inner sleeve 12 is free to rotate 360 degrees inside outer sleeve 10.

The open end 14 of inner sleeve 12 is slightly offset from the open end 16 of outer sleeve 10 to define a circular recess 13. This recess 13 acts to protect the inner sleeve 12 while inserting insert I into receptacle R.

Two nibs or locking members 18 and 20 are mounted to the inner wall 22 adjacent end 14 of inner sleeve 12. The locking members 18 and 20 are positioned approximately 180 degrees apart. While the present invention shows two locking members, it is contemplated to be within the scope of this invention to have as few as one locking member, or more than two locking members.

In a preferred embodiment, locking members 20 and 18 are each in the form of a four sided projection including flat top 17, with its cross-section being generally square.

Figure 3A:
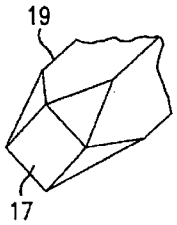
FIG. 3A is an enlarged view of the locking member, showing in dotted lines an alternative embodiment thereof.

In another preferred embodiment (shown by dotted lines in FIG. 3A), corners 19 may be slightly tapered or bevelled as desired, while still maintaining flat top surface 17, in order to reduce wear on the contacting surfaces of the tool components. It is within the scope the present invention to provide other configurations for the locking members so long as the locking members can rigidly engage insert I.

Figure 2:
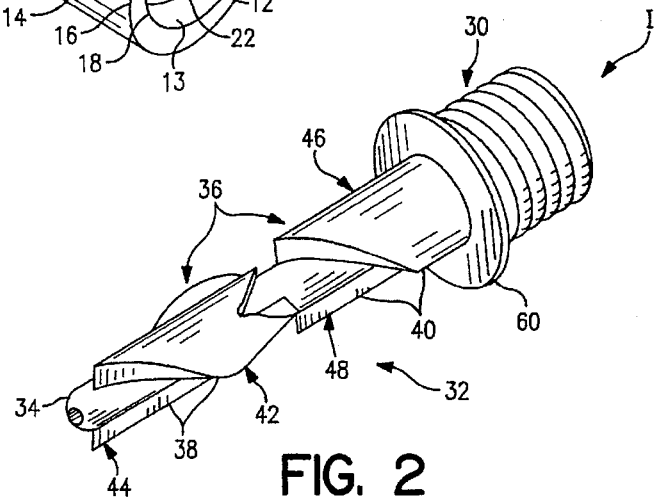

As shown in FIG. 2, insert I is generally cylindrical in shape and includes a base portion 30 and a cam portion 32. Base portion 30 is threaded for attachment to an object (not shown) to be lifted. Cam portion 32 includes an elongated center extension 34 and a cam 36 positioned on and peripheral to center extension 34.

As best shown in FIGS. 5 and 6, cam 36 includes a front guide 38 and a rear guide 40. Front guide 38 is axially spaced apart from rear guide 40. Front guide 38 includes two generally diametrically opposed spiral members 42 and 44 which are identical in size and configuration. Likewise, rear guide 40 includes two generally diametrically opposed spiral members 46 and 48, which are also identical in size and configuration. Rear spiral members 46 and 48 are positioned axially offset with front spiral members 42 and 44. Each of the front and rear spiral members 42, 44, 46 and 48 is preferably generally triangular in shape. While two spiral members are shown for each of the front and rear guides, it is within the scope of the present invention to provide a single spiral member for each of the front and rear guides, or to provide more than two spiral members for each of the front and rear guides.

As best shown in FIGS. 5 and 6, front spiral members 42 and 44 each have entrance spiral edges 50 and 54, and an exit spiral edge 52. A front slot 56 is provided in each of the front spiral members 42 and 44 generally nearest rear guide 40. Front slot 56 is shaped to effectively receive either of locking members 18 and 20.

As best shown in FIGS. 5 and 6, entrance spiral edges 50 of each front spiral member 42 and 44 slope downwardly toward base 30 at an angle to the central longitudinal axis x of extension 34, and entrance spiral edges 54 thereof extend generally parallel to axis x. Likewise, exit spiral edges 52 of each front spiral member 42 and 44 also slope downwardly toward base 30 at an angle to the central longitudinal axis of extension 34 but at an angle generally perpendicular to entrance spiral edges 50.

As further best shown in FIGS. 5 and 6, each of rear spiral members 46 and 48 has an alignment spiral edge 57, an exit edge 59 and a rear slot 58. Alignment spiral edges 57 of each rear spiral member 46 and 48 slope downwardly toward base 30 at an angle to the central longitudinal axis of extension 34, and exit edges 59 thereof extend generally parallel to axis x. Rear slot 58 is positioned near base 30 and is shaped to effectively receive either of locking members 18 and 20.

Figure 3:
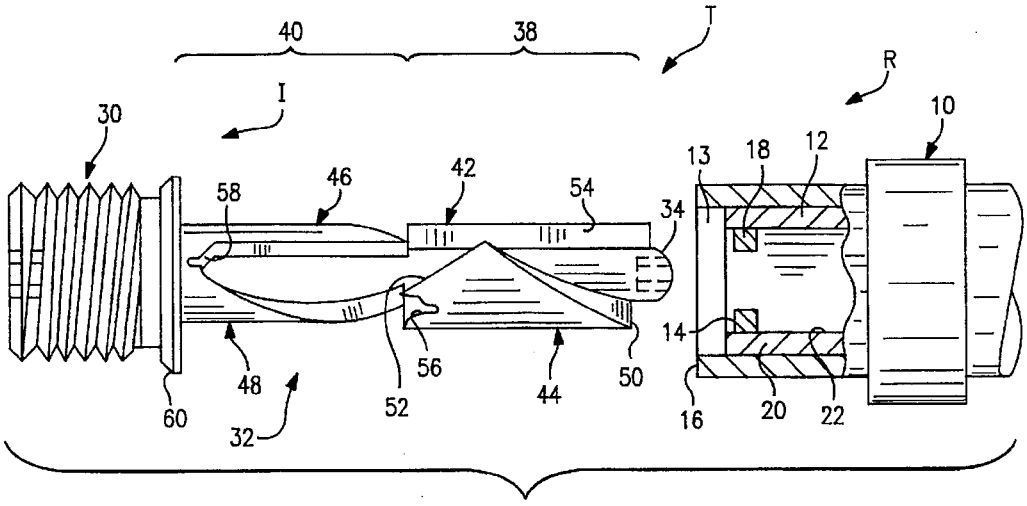
FIG. 3 is a side elevational view of the tool of the present invention with a partial cross-section of the receptacle, showing the insert aligned with the receptacle prior to insertion.
Figure 4:
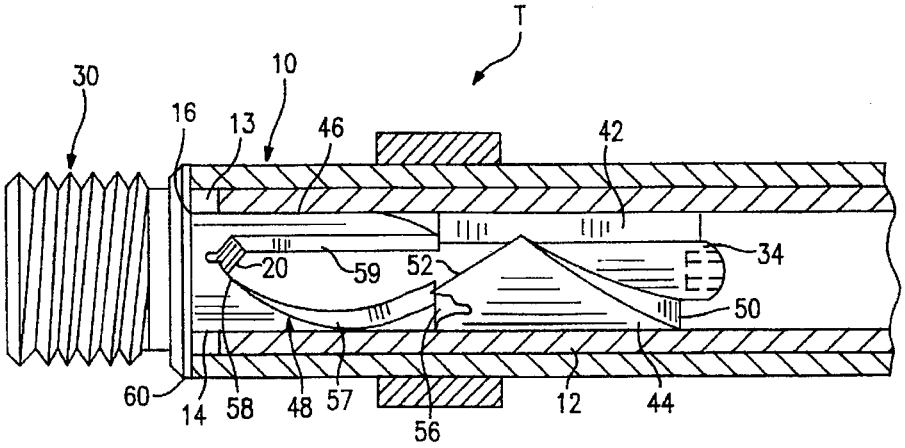
FIG. 4 is a side elevational view of the tool of the present invention with a cross-section of the receptacle, showing the insert fully inserted into the receptacle.

As shown in FIGS. 2–4, insert I includes a flange 60 positioned intermediate base 30 and cam portion 32 for preventing overinsertion of insert I into receptacle R (see FIG. 4).

The dimensions of insert I and receptacle are such that cam 36 can be readily inserted into and removed from inner sleeve 12, while maintaining a tightly controlled fit.

OPERATION

In operation, receptacle R is attached to the end of a Powered Axial Locating Mechanism PALM) (not shown) or other lifting device, while insert I is connected to the object to be retrieved or picked up (not shown) by base 30.

As shown in FIG. 3, receptacle R is generally axially aligned with insert I prior to placing insert I into receptacle R. As insert I is inserted into receptacle R, the recess 13 acts as a guide to help align cam portion 32 with inner sleeve 12, allowing locking members 18 and 20 to engage front spiral members 42 and 44 of front guide 38.

Referring now to FIG. 5, a schematic illustration of the receptacle R engaging the insert I is shown. Front spiral members 42 and 44, and rear spiral members 46 and 48 are shown flat and locking member 20 is shown in cross section. Locking member 18, although not shown in FIG. 5, engages the insert I in the same manner as described below.

As inner sleeve 12 is moved over cam 36, locking member 20 will be positioned somewhere between entrance spiral edges 50 and 54 of front spiral members 44 and 42, respectively. If locking member 20 engages entrance spiral edge 54 of spiral member 42, locking member 20 will move along path y generally parallel to axis x until it engages alignment spiral edge 57 of rear spiral member 48 as inner sleeve 12 is moved toward base 30. If, on the other hand, locking member 20 engages entrance spiral edge 50 of front spiral member 44, inner sleeve 12 will rotate thereby moving locking member 20 down entrance spiral edge 50 along path z until it engages alignment spiral edge 57 of rear spiral member 48, as inner sleeve 12 is moved toward base 30.

Once locking member 20 engages alignment spiral edge 57 of rear spiral member 48 and as inner sleeve 12 is further moved toward base 30, locking member 20 would continue to move down along alignment spiral edge 57 until locking member 20 is in vertical alignment with slot 56.

When locking member 20 is positioned in alignment with front slot 56, receptacle R is then moved up or away from base 30 causing locking member 20 to securely engage slot 56. This allows the object into which the insert I is connected to be lifted or pulled up. Although not shown, an external visual "engagement" marking would be provided at a convenient location on or about the tool to indicate to an operator that the locking members 18 and 20 are in vertical alignment with corresponding slots 56.

While FIG. 5 illustrates locking member 20 being initially oriented with entrance spiral edges 50 and 54 of front spiral members 44 and 42, respectively, it is contemplated that locking member 20 could be oriented in any position therebetween with the ultimate engagement of locking member 20 with slot 56 operating in substantially the same manner as described above.

Referring now to FIG. 6, a schematic illustration of the receptacle R disengaging from the insert I is shown. Front spiral members 42 and 44, and rear spiral members 46 and 48 are shown flat and locking member 20 is shown in cross-section.

In order to disengage insert I from receptacle R, the object being held is lowered until the object comes to rest (not shown) on a support surface. Receptacle R is then lowered relative to insert I so as to disengage locking member 20 from front slot 56. As receptacle R is continued to be lowered, locking member 20 would first engage alignment spiral edge 57 of rear spiral member 48 and upon continued lowering of receptacle R would cause inner sleeve 12, and thereby locking member 20, to rotate, until locking member 20 engages rear slot 58. As can be seen from FIG. 6, in this position locking member 20 would be in vertical alignment with exit spiral edge 52 of front spiral member 42.

Receptacle R is then lifted or moved away from base 30 with locking member 20 following rear exit edge 59 of spiral member 46 along path xx to exit spiral edge 52. When locking member 20 engages exit spiral edge 52 of front spiral member 42, inner sleeve 12 and locking member 20 rotate free of engagement with insert I along path yy.

As the engagement marking noted above, an external visual "disengagement" marking would be provided at a suitable location to indicate to the operator that locking members 18 and 20 are in slots 58 and therefore in vertical alignment with corresponding exit spiral edges 52.

An advantage of the rotating inner sleeve 12 is that locking members 18 and 20 do not have to be in any specific orientation prior to engagement. Front spiral members 42 and 44 automatically align locking members 18 and 20 for engagement and disengagement. In addition, no special resetting of either of receptacle R or insert I is needed after disengagement.

As can be seen in FIG. 4, when locking member 20 engages with rear slot 58, outer sleeve 10 will come in contact with flange 60 thus preventing overinsertion of insert I and any damage to receptacle R, insert I, or the object to be lifted.

While this invention has been described as having a preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A device for releasably holding an object, comprising:

a) receptacle means;

b) insert means dimensioned to fit within said receptacle means;

c) one of said receptacle means and said insert means including a cam;

d) the other of said receptacle means and said insert means including a locking member capable of negotiating along said cam for engaging and disengaging said receptacle means with said insert means, said locking member being in the form of a four sided protection;

e) one of said receptacle means and said insert means including means for attaching to an object; and f) whereby the object can be held by engaging said receptacle means with said insert means and released by disengaging the same.

2. The device as recited in claim 1, wherein:

a) said receptacle means includes a housing and a rotatable member; and b) said rotatable member is positioned within said housing.

3. The device as recited in claim 2, wherein:

a) said housing includes an outer sleeve;

b) said rotatable member includes an inner sleeve; and c) said inner sleeve is concentric with said outer sleeve.

4. The device as recited in claim 1, wherein:

a) said insert means is generally cylindrical in shape and includes a base portion and a cam portion;

b) said cam portion includes a generally center extension and said cam on the periphery thereof; and c) said cam includes axially spaced front and rear guides.

5. The device as recited in claim 4, wherein:

a) said locking member is positioned within said receptacle means.

6. The device as recited in claim 5, wherein:

a) said front guide includes a front spiral member; and b) said rear guide includes a rear spiral member positioned in generally axially offset relationship to said front spiral member.

7. The device as recited in claim 6, wherein:

a) said front spiral member and said rear spiral member each includes entrance and exit spirals.

8. The device as recited in claim 7, wherein:

a) said rear spiral member includes a slot for axially aligning said locking member with said exit spiral of said front spiral member.

9. The device as recited in claim 6, wherein:

a) said front spiral member includes a slot for releasably receiving said locking member to thereby engage said receptacle means with said insert means.

10. The device as recited in claim 4, wherein:

a) said front guide includes a pair of generally diametrically opposed front spiral members; and b) said rear guide includes a pair of generally diametrically opposed rear spiral members positioned in axially offset relationship to said front spiral members.

11. A device as recited in claim 1, and including:

a) means for preventing overinsertion of said insert means into said receptacle means.

12. A device for releasably holding an object, comprising:

a) a receptacle including an outer sleeve and a rotatable inner sleeve;

b) said inner sleeve coaxially positioned within said outer sleeve;

c) said inner sleeve including at least one locking member in the form of a four sided projection;

d) an insert dimensioned to fit within said receptacle;

e) said insert including a cam portion, so that when said cam portion is inserted into said inner sleeve, said locking member engages said cam portion for locking said receptacle with said insert.

13. The device as recited in claim 12, wherein:

a) said insert includes a base portion;

b) said cam portion includes a generally center extension and a peripheral cam; and c) said cam includes axially spaced front and rear guides.

14. The device as recited in claim 13, wherein:

a) said locking member positioned within said inner sleeve has tapered edges sufficient to reduce wear on contacting surfaces of said device.

15. The device as recited in claim 13, wherein:

a) said front guide includes a front spiral member; and b) said rear guide includes a rear spiral member positioned in generally axially offset relationship to said front spiral member.

16. The device as recited in claim 15, wherein:

a) said front spiral member and said rear spiral member each includes entrance and exit spirals.

17. The device as recited in claim 16, wherein:

a) said front spiral member includes a slot for releasably receiving said locking member to thereby engage said receptacle with said insert.

18. The device as recited in claim 17, wherein:

a) said rear spiral member includes a rear slot for axially aligning said locking member with said exit spiral of said front spiral member.

19. The device as recited in claim 13, wherein:

a) said front guide includes a pair of generally diametrically opposed front spiral members; and b) said rear guide includes a pair of generally diametrically opposed rear spiral members positioned in axially offset relationship to said front spiral members.

20. The device as recited in claim 13, and including:

a) a flange positioned adjacent said base portion for preventing overinsertion of said insert into said receptacle.

* * * * *